US011937671B2

(12) United States Patent
Crowley et al.

(10) Patent No.: US 11,937,671 B2
(45) Date of Patent: Mar. 26, 2024

(54) JEWELRY WITH CHANGEABLE INLAYS

(71) Applicant: SBOX Holdings LLC, Logan, UT (US)

(72) Inventors: William Mckay Crowley, South Jordan, UT (US); David Gordon Baird, Provo, UT (US)

(73) Assignee: SBOX Holdings LLC, Logan, UT (US)

( * ) Notice: Subject to any disclaimer, the term of this patent is extended or adjusted under 35 U.S.C. 154(b) by 80 days.

(21) Appl. No.: 17/641,403

(22) PCT Filed: Sep. 10, 2020

(86) PCT No.: PCT/US2020/050231
§ 371 (c)(1),
(2) Date: Mar. 8, 2022

(87) PCT Pub. No.: WO2021/050751
PCT Pub. Date: Mar. 18, 2021

(65) Prior Publication Data

US 2022/0287419 A1 Sep. 15, 2022

Related U.S. Application Data

(60) Provisional application No. 62/898,326, filed on Sep. 10, 2019.

(51) Int. Cl.
*A44C 9/00* (2006.01)
*A44C 5/00* (2006.01)

(52) U.S. Cl.
CPC ..... *A44C 9/0023* (2013.01); *A44C 5/0084* (2013.01)

(58) Field of Classification Search
CPC ..... Y10T 29/49826; Y10T 24/17; A45D 8/34; A45D 8/00; A45D 2008/002; A45D 2008/345; A45D 8/36; A44C 5/00; A44C 5/0007; A44C 5/003; A44C 5/12; A44C 9/0092; A44C 15/003; A44C 9/0084; A44C 5/0053; A44C 5/0084; A44C 9/0023;
(Continued)

(56) References Cited

U.S. PATENT DOCUMENTS 10,555,586 B1 * 2/2020 Yeager, Jr. ..... A44C 5/0007
10,736,386 B1 * 8/2020 Hutchins ..... A44C 15/0025
(Continued)

FOREIGN PATENT DOCUMENTS

RU 2681596 C1 3/2019

OTHER PUBLICATIONS

Lindner, Nora (Authorized PCT Officer), International Preliminary Report on Patentability ) with International Written Opinion) dated Mar. 15, 2022 in corresponding International Application No. PCT/US202/050231, 5 pages.
(Continued)

*Primary Examiner* — Jack W Lavinder
(74) *Attorney, Agent, or Firm* — MH2 TECHNOLOGY LAW GROUP LLP

(57) ABSTRACT

An article of jewelry is provided that includes a base with one or more channels in an outward facing surface portion of the base. One or more inlays can be placed in the one or more channels. The inlays can be formed of an elastomeric material that elastically holds the inlays intension within the channel and allows repeated removal and addition to the channel without fracturing.

16 Claims, 9 Drawing Sheets

(58) Field of Classification Search
CPC ..... G04B 37/00; G04B 37/005; A41D 20/00; G09F 3/005; G09F 3/14
USPC ..... 63/15, 15.7, 40; D11/26, 37, 38, 39
See application file for complete search history.

(56) References Cited

U.S. PATENT DOCUMENTS

| | | | | |
|---|---|---|---|---|
| 2007/0044512 | A1 | 3/2007 | Smith | |
| 2009/0056373 | A1 | 3/2009 | Czajka et al. | |
| 2013/0239611 | A1 | 9/2013 | Patterson | |
| 2015/0257497 | A1 | 9/2015 | Nevatia et al. | |
| 2017/0017289 | A1 | 1/2017 | Teoh et al. | |
| 2018/0078009 | A1* | 3/2018 | Luig | A44C 17/0208 |

OTHER PUBLICATIONS

International Search Report and Written Opinion in corresponding International Application No. PCT/US2020/050231 dated Nov. 12, 2020, 6 pages.

* cited by examiner

JEWELRY WITH CHANGEABLE INLAYS

CROSS REFERENCE TO RELATED APPLICATION

This application is a national stage entry of PCT/US2020/050231 filed Sep. 10, 2020, published as WO 2021/050751 A1 on Mar. 18, 2021, which claims the benefit of U.S. Provisional Application No. 62/898,326 filed Sep. 10, 2019, the disclosure of all of which are hereby incorporated by reference in its entirety.

FIELD

The present disclosure generally relates to jewelry and, more particularly, to jewelry with changeable elastomeric inlays.

BACKGROUND

People wear jewelry as an accessory for a number of reasons. They may want jewelry to match or complement clothes, to show support for a school, sports team, or cause, to indicate status, or to simply wear something that is unique. Conventional jewelry, however, cannot easily be changed once fabrication is completed. For example, in order to match several different outfits, several different rings may be needed. Additionally, a color or colors that an individual may want to display on jewelry many not be available as a precious metal, a gemstone, or other conventional jewelry materials. And some colors, such as the blue/purple of tanzanite are prohibitively expensive.

Jewelry that allows a wearer to easily make changes to, for example, the color, style, or texture would be desirable.

SUMMARY

According to the present teachings, an article of jewelry is provided that includes a base comprising an annular shape, wherein the base further comprises one or more channels disposed circumferentially in an outward facing portion of the annular shape and one or more inlays comprising an elastomer, wherein each of the one or more inlays comprise an annular shape and a diameter to be elastically held in tension within one of the one or more channels, wherein the elastomer comprises an elasticity to allow repeated removal of the one or more inlays from the one or more channels without fracturing.

According to the present teachings, the article of jewelry can optionally include the base comprising metal, wood, ceramic, porcelain, zirconium, meteorite, stone, or combinations thereof. The article of jewelry can further optionally include the one or more channels comprise a bottom and a plurality of sides, a shape of the bottom and the plurality of sides being flat, curved, V-shaped, or combinations thereof; the one or more channels have a depth from about 0.5 mm to about 5.0 mm; and/or the one or more channels comprise a repeating pattern, a design, or both. The article of jewelry can also optionally include the one or more inlays comprise a silicone elastomer, a natural rubber, a styrene-butadiene block copolymer, a polyisoprene, polybutadiene, an ethylene propylene rubber, an ethylene propylene diene rubber, a fluoroelastomer, a polyurethane elastomer, a nitrile rubber, latex, or combinations thereof; each of the one or more inlays comprise a color, a pattern, a texture, a phosphorescence, a material suspended in the elastomer, or combinations thereof; the elastomer is a porous material and further comprise a liquid, an oil, a wax, a gel, or combinations thereof to emit a scent; the one or more inlays and a portion of the base form an outer surface of the article of jewelry that visually appears smooth and continuous when each of the one or more inlays are elastically held in tension within one of the one or more channels; the one or more inlays comprise an open portion such that a portion of a bottom of the channel, some or all of a side of the channel, or both are exposed when each of the one or more inlays are elastically held in tension within one of the one or more channels; and the one or more inlays comprise a braided shape, a shape that extends above a height of the channel, one or more three dimensional shapes that extend above the height of the channel, or one or more holes that extend through the inlay and are sized to hold gemstones. Further, the article of jewelry can be a ring, a bracelet, a necklace, or an earring.

According to the present teachings, an article of jewelry is provided that includes a base comprising one or more channels disposed in a surface portion of the base and one or more inlays comprising an elastomer, wherein each of the one or more inlays comprise at least one dimension to elastically hold the one or more inlays in tension within the one or more channels, and wherein the elastomer comprises an elasticity to allow repeated removal of the one or more inlays from the one or more channels without fracturing According to the present teachings, the article of jewelry can be a ring, a pendant, an earring, a bracelet, or a necklace. The article of jewelry can optionally include the base comprising metal, wood, ceramic, porcelain, zirconium, meteorite, stone, or combinations thereof and wherein the one or more inlays comprise a silicone elastomer, a natural rubber, a styrene-butadiene block copolymer, a polyisoprene, polybutadiene, an ethylene propylene rubber, an ethylene propylene diene rubber, a fluoroelastomer, a polyurethane elastomer, a nitrile rubber, latex, or combinations thereof. The article of jewelry can further optionally include the one or more inlays have a color, a pattern, a texture, a phosphorescence, or a combination thereof and/or the one or more inlays comprise a different color, texture, or combinations thereof. The article of jewelry can further optionally include the one or more channels being discontinuous, the one or more channels that are discontinuous together form a shape, and a side of the one or more channels comprise one or more holes that extend from the channel to an outer side of the article of jewelry.

It is to be understood that both the foregoing general description and the following detailed description are exemplary and explanatory only and are not restrictive of the disclosure, as claimed.

BRIEF DESCRIPTION OF THE DRAWINGS

The accompanying drawings, which are incorporated in and constitute a part of this specification, illustrate the present disclosure and together with the description, serve to explain the principles of the present disclosure.

DESCRIPTION

Reference will now be made in detail to exemplary implementations of the present disclosure, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary implementations in which the present disclosure may be practiced. These implementations are described in sufficient detail to enable those skilled in the art to practice the present disclosure and it is to be understood that other implementations may be utilized and that changes may be made without departing from the scope of the present disclosure. The following description is, therefore, merely exemplary.

Currently, jewelry cannot be easily customized after fabrication is completed. The disclosed jewelry allows an individual to repeatedly customize the jewelry at any time by removing and adding elastomeric inlays without any tools. The elastomeric inlays are elastically held in channels that can, for example, extend around the outer surface of the jewelry and can be dimensioned so that the outer surface of the jewelry appears visually smooth and continuous. The inlays can vary in color, style, shape, design, and texture and are formed of an elastomeric material that allows the inlays to be repeatedly added and removed from the channels without fracturing.

Figure 1A:
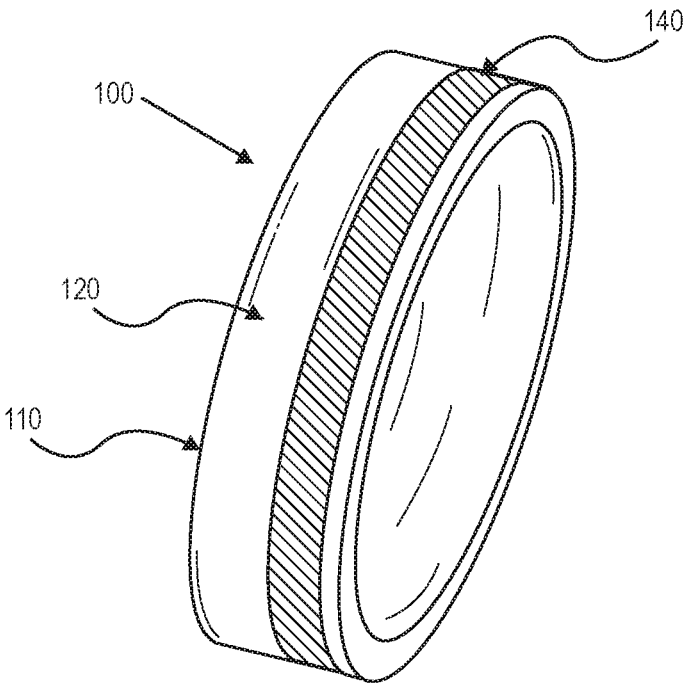
FIG. 1A depicts an article of jewelry including an inlay that can be repeatedly removed and added in accordance with the present teachings.
Figure 1B:
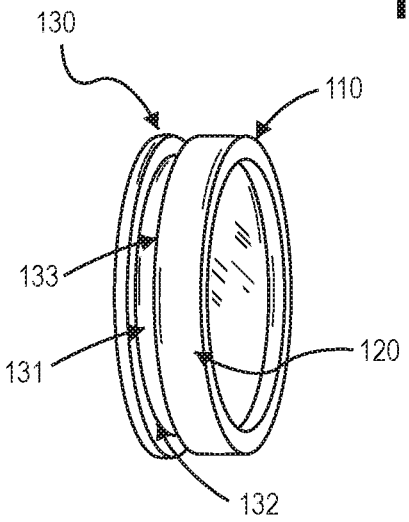
FIG. 1B depicts a base portion of an article of jewelry including one or more channels in an outer surface of the base in accordance with the present teachings.

FIG. 1A depicts an article of jewelry 100, for example a ring, in accordance to the present teachings. Article of jewelry 100 can include a base 110 having a surface portion 120, for example that faces outward, and one or more inlays 140. FIG. 1B shows base 110 where article of jewelry 100 is in the form of a ring and formed of a metallic material. Although depicted as a ring for illustration purposes, one of ordinary skill in the art will understand that article of jewelry 100 can be any jewelry or accessory including, but not limited to earrings, bracelets, pendants and necklaces.

Base 110 can be formed of a solid material including, but not limited to metal, wood, ceramic, porcelain, zirconium, meteorite, stone, or combinations thereof. Depending on the type of jewelry, base 110 can have a shape as desired, for example, round, oval, rectangular, square, polygonal and other geometric or non-geometric shapes. Base 110 can have a width, diameter, and thickness that varies as desired, for example, to fit on the finger of a wearer.

As shown in FIG. 1B, base 110 can further include one or more channels 130 within surface portion 120, where the one or more channels extend around an outward facing circumference of surface portion 120. Channels 130 can include a bottom 131 and a plurality of sides 132, 133, where a shape of bottom 131 and the plurality of sides 132, 133 can be flat, curved, or combinations thereof. Channels 130 can also include a V-shaped bottom. Channels 130 can have a depth of about 0.5 mm to about 5.0 mm. The number, location, and size of the one or more channels 130 can vary.

Figure 2A:
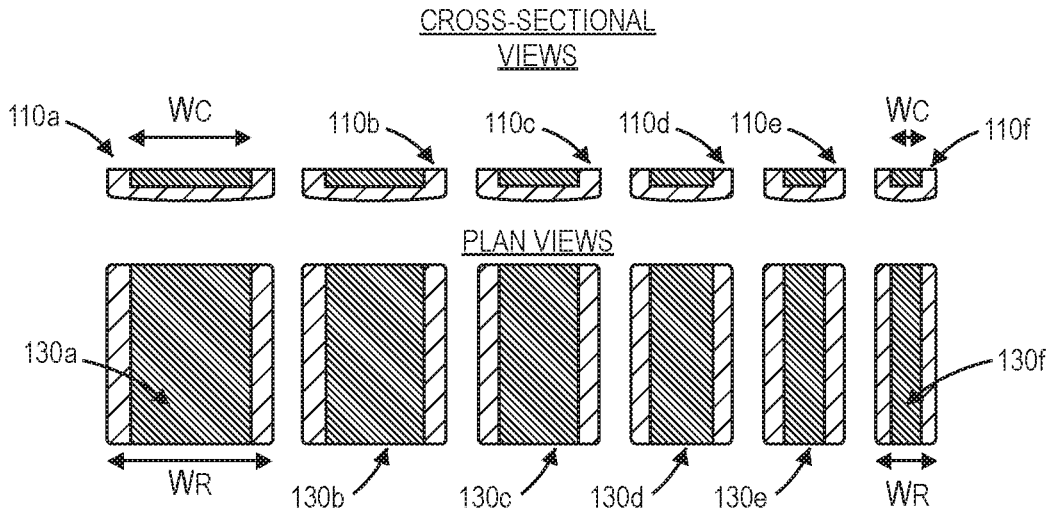
FIGS. 2A-B depict cross-sectional and plan views of exemplary locations and widths of inlays disposed in channels on the article of jewelry in accordance with the present teachings.

FIGS. 2A-D depict non-limiting examples of locations, widths, shapes and numbers of channels. For example, FIG. 2A shows examples of base 110, of for example a ring, having a channel width $W_C$ and a ring width $W_R$. The lower portion of FIG. 2A shown a front view (also referred to herein as a plan view) of a base with an inlay and the upper portion of FIG. 2A corresponds to a cross-section of the front view of the base below it. Although the shape of the channels are depicted as rectangular (having a flat base), the shape of the channels can have a shape as desired, for example, flat, rounded, triangular, etc., so that the base of the channel can be flat, curved, rounded or any other shape. Ring width $W_R$ can vary as shown from relatively wider in base 110*a* to relatively narrower shown as in base 110*b*, 110*c*, 110*d*, 110*e*, and 110*f*. A diameter of base 110*b*, 110*c*, 110*d*, 110*e*, and 110*f* can also vary to allow fit on a wearer's finger. FIG. 2A further depicts embodiments with a single channel having channel width $W_C$ that can vary from a relatively wider channel 130*a* to relatively narrower as shown in channels 130*b*, 130*c*, 130*d*, 130*e*, and 130*f*.

Figure 2B:
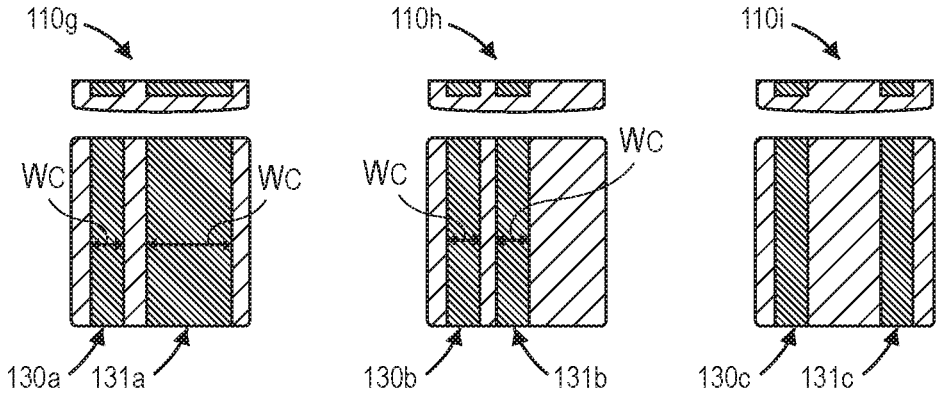

FIG. 2B shows additional examples of base 110, of for example a ring, having a plurality of channels including an inlay. The lower portion of FIG. 2B shown a front view of a base and the upper portion of FIG. 2B corresponds to a cross-section of the front view of the base below it. Bases 110*g*, 110*h*, and 110*i* can have a width and diameter as desired and each includes two channels. For example, base

110*g* includes a first channel 130*a* and a second channel 131*a*. First channel 130*a* has a width $W_C$ that is narrower than a width $W_C$ of second channel 131*a*. Base 110*h* includes a first channel 130*b* and a second channel 131*b*. First channel 130*b* has a width $W_C$ that is similar (equivalent) to a width $W_C$ of second channel 131*b*. Base 110*i*, similar to base 110*h*, includes a first channel 130*c* and a second channel 131*c* where first channel 130*c* has a width $W_C$ that is similar (equivalent) to a width $W_C$ of second channel 131*c*. A location of the plurality of channels within the base can further be varied as desired, for example to be aesthetically pleasing. FIG. 2B shows channels 130*b* and 131*b* arranged asymmetrically in base 110*g* and channels 130*c* and 131*c* arranged symmetrically in base 110*i*. Although FIG. 2B depicts the plurality of channels as two channels in the base, one of ordinary skill in the art will understand that more than two channels, for example, three, four, or five, channels can be included in the base and spaced evenly or unevenly from each other.

Figure 2C:
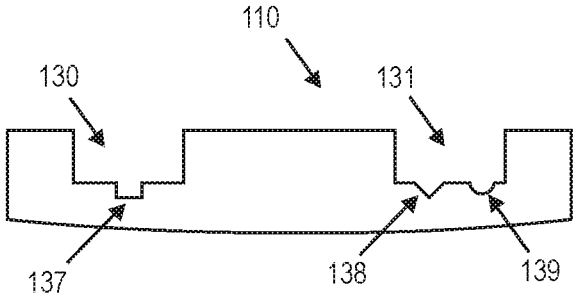
FIG. 2C depicts a cross-sectional view of a base including one or more channels with a sub-channel in accordance with the present teachings.

As disclosed herein, article of jewelry 100 can include one or more channels having widths and locations as desired on base 110. FIG. 2C depicts a cross sectional view of a channel in a base that can optionally include a sub-channel within the channel. Base 110 can include channel 130 and a subchannel 137 within channel 130. Subchannel 137 includes a width and a depth that is less than a width and a depth of channel 130. A shape of subchannel can vary as desired. Non-limiting examples of subchannel shape include square, rectangular, triangular, rounded based shapes such as semicircular. A channel can further optionally include a plurality of subchannels. FIG. 2C depicts a channel 131 including first subchannel 138 and a second subchannel 139. First subchannel 138 and a second subchannel 139 can have a width that is less than the width of channel 131. First subchannel 138 can have dimensions and a shape as desired, for example a triangular shape. Second subchannel 139 also has dimensions and a shape as desired, for example a rounded or hemispherical shape. In use, a wearer of the article of jewelry can place a scented oil or perfume within the subchannels. An inlay can then be placed in the channel to control release of the scented oil or perfume.

Figure 2D:
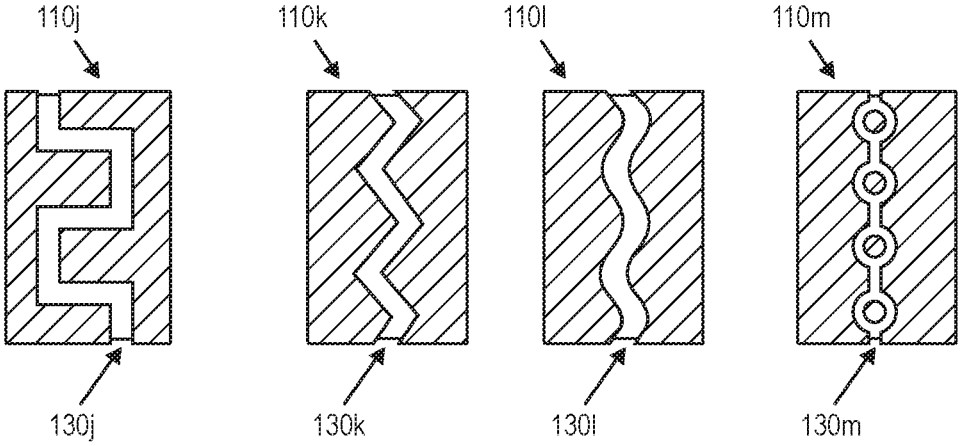
FIG. 2D depicts a front view of articles of jewelry with one or more channels in the base where the one or more channels include a pattern or a design.

Article of jewelry 100 can further include one or more channels having a pattern, for example one or more repeating shapes, a design, or both. FIG. 2D shows a front view of several exemplary channels including a pattern or a design. Body 110*j* includes a channel 130*j* having a crenellated pattern; body 110*k* includes a channel 130*k* having a zig-zag pattern; and body 110*l* includes a channel 130*l* having a sinusoidal (repeating smooth curves) pattern. FIG. 2D further shows a body 110*m* including a channel 130*n* having design comprising a plurality of circles connected by lines. One of ordinary skill in the art will appreciate the patterns and designs of the channels depicted in FIG. 2D are exemplary and other patterns and designs can be used. For example, a design can depict an image, text, or logo. Inlays matching the pattern and/or design of the channel can be provided to be repeatably inserted and removed from the channel.

Figure 2E:
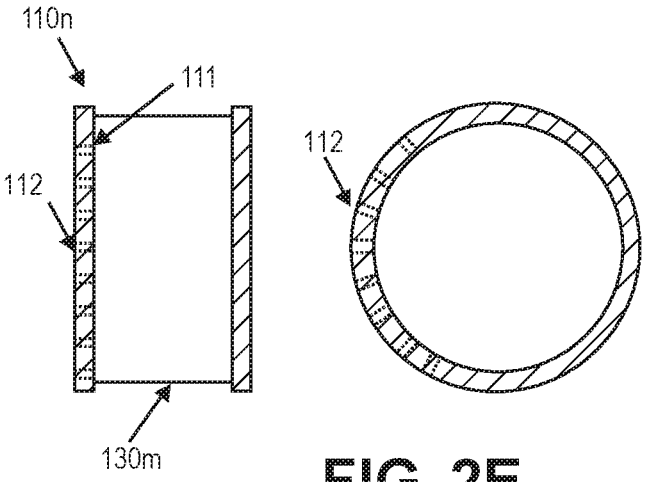
FIG. 2E depicts side and front views of an article of jewelry with holes in the channel sidewall in accordance with the present teachings.

Article of jewelry 100 can further include one or more channels having holes through a sidewall, for example, to highlight a color of the inlay from a side view (either top or bottom of article of jewelry 100). FIG. 2E shows a front view of a base 110*n* including a channel 130*m*. Base 110*n* includes a wall portion 111 including one or more holes 112 that extend through wall portion 111. When an inlay is disposed in channel 130*m*, a color of the inlay will show through (i.e., bleed through) the one or more holes 112 in wall portion 111 when article of jewelry is viewed from a top (or bottom) perspective. Optionally, a gemstone can be mounted on a side of the one or more holes opposite from the inlay.

Article of jewelry 100 can further include one or more inlays 140 as shown in FIG. 1A. Inlays 140 can comprise a polymer including, but not limited to, a silicone elastomer, a natural rubber, a styrene-butadiene block copolymer, a polyisoprene, polybutadiene, an ethylene propylene rubber, an ethylene propylene diene rubber, a fluoroelastomer, a polyurethane elastomer, a nitrile rubber, latex, or combinations thereof. The dimensions and polymer forming Inlay 140 allow inlay 140 to be elastically held in tension within channel 130. Moreover, inlay 140 can be repeatedly removed and added into the one or more channels without fracturing. Inlay 140 can be easily removed or added by hand without the need for tools. When elastically held in tension and/or compression within channel 130, one or more inlays 140 and surface portion 120 can appear visually smooth and continuous as depicted in FIG. 1A.

Figure 1C:
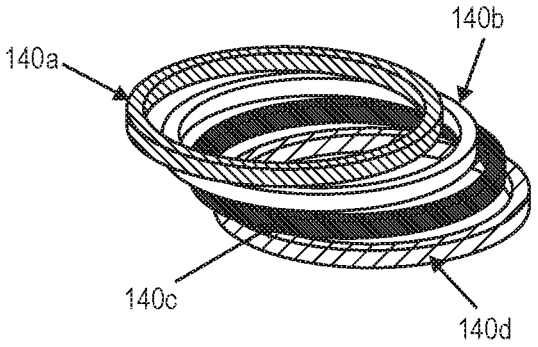
FIG. 1C depicts a plurality of inlays having a dimension and a shape to match the shape and dimensions of the channels and where the inlays have different colors in accordance with the present teachings.

Inlays 140 can have a shape to match a cross sectional shape of base 110. In other words, inlays 140 form a continuous loop and have a shape to match a shape of the base. For example, FIG. 1B shows base 110 as a ring and FIG. 1C shows inlays 140*a-d* having an annular shape to match the ring shape of base 110. Similarly, earrings, a bracelet, or a necklace having a rectangular cross-sectional shape for base 110, can include an inlay 140 that has a rectangular shape to match. Inlays 140 can have a thickness of about 0.5 mm to about 5.0 mm.

Inlays can further include a color, a pattern, a texture, a phosphorescence, or a combination thereof. FIG. 1C, for example, shows inlays with various colors. Exemplary inlay 140*a* has a red color, inlay 140*b* has a white color, inlay 140*c* has a blue color, and inlay 140*d* has a teal color.

Figure 3A:
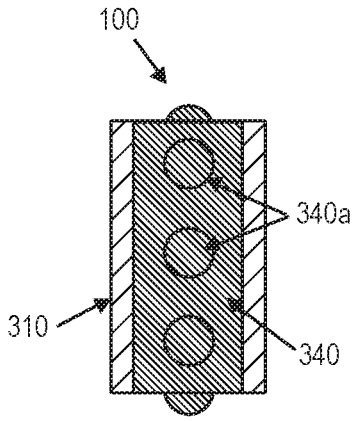
FIGS. 3A-D depict articles of jewelry with inlays disclosed in the one or more channels where the inlay includes patterns, 3D patterns, and open portions that expose a channel bottom and/or some or all of the sides of the channel in accordance with the present teachings.
Figure 3B:
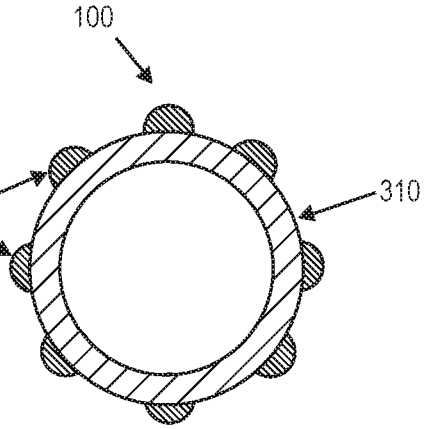
Figure 3C:
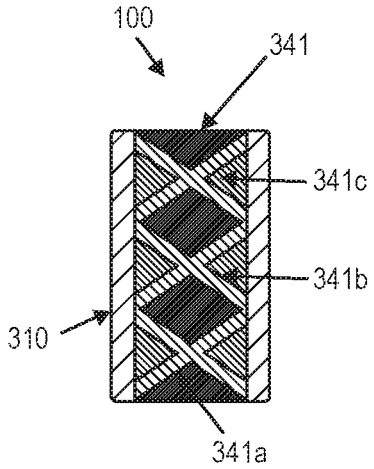
Figure 3D:
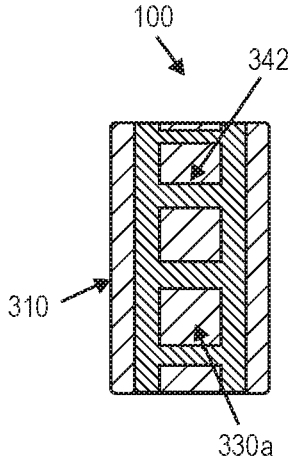

Although FIG. 1A depicts inlays 140 completely filling channel 130 with respect to depth and width to provide a flush appearance, inlays can optionally have a different cross-sectional shapes, sizes, and textures. FIG. 3A depicts a front view an article of jewelry 100, for example a ring, including a base 310 and an inlay 340 that completely fills the channel. Inlay 340, however, further includes one or more three dimensional shapes 340*a*. FIG. 3B shows a top view of article of jewelry 100 and one or more three dimensional shapes 340*a*. FIG. 3C shows a front view of an article of jewelry 100, for example a ring, including a base 310 and an inlay 341 that completely fills the channel within base 310. Inlay 341, however, further includes a pattern. For example, the pattern can include one or more pattern elements 341*a-c*, each pattern element having a same or a different color. FIG. 3D depicts shows a front view of an article of jewelry 100, for example a ring, including a base 310 and an inlay 342 that fills a width of channel 330 but further includes one or more open portions that expose portions of channel bottom 330*a*. For example, the one or more open portions can expose a portion of the channel bottom, some or all of the sides of the channel, or both the channel bottom and some or all of the sides of the channel.

One of ordinary skill in the art will appreciate that the inlay can include 2- and 3-dimensional shapes, patterns, open portions, and textures, for example, non-smooth textures and woven patterns. One of ordinary skill in the art will further appreciate that the 3-dimensional shapes and patterns on the inlay depicted in FIGS. 3A-B are exemplary and other shapes, patterns, open portions, and textures can be used.

Figure 4A:
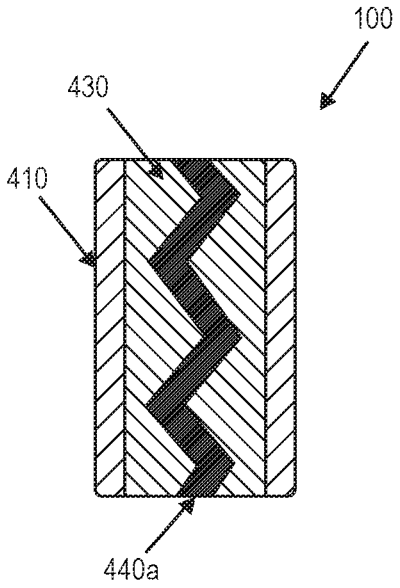
FIGS. 4A-B depict a front view of a base including channels and inlays with patterns and/or designs in accordance with the present teachings.
Figure 4B:
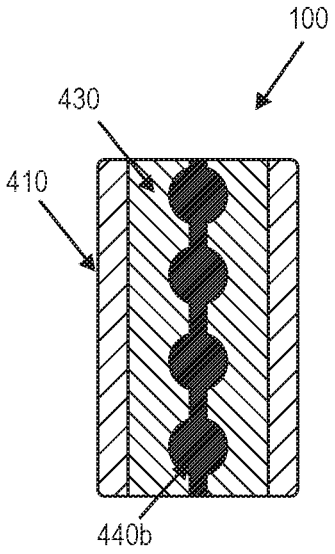

Inlays can optionally not completely fill the channels in the article of jewelry. FIGS. 4A-B depict a front view an article of jewelry 100, for example a ring, including a base 410 and a channel 430. FIG. 4A further depicts an inlay 440*a* having a zig zag shape disposed in channel 430 without completely filling channel 430. In other words, the dimensions and/or shape of inlay 440*a* do not match the dimensions and/or shape of channel 430. Another exemplary inlay is depicted in FIG. 4B. An inlay 440*b* includes a pattern comprising repeating shapes disposed in channel 430 without completely filling channel 430. Similarly, the dimensions and/or shape of inlay 440*b* do not match the dimensions and/or shape of channel 430. One of ordinary skill in the art will appreciate the dimensional, shapes, and patterns of the inlays depicted in FIGS. 4A-B are exemplary and other dimensions, shapes, and patterns can be used.

Figure 5:
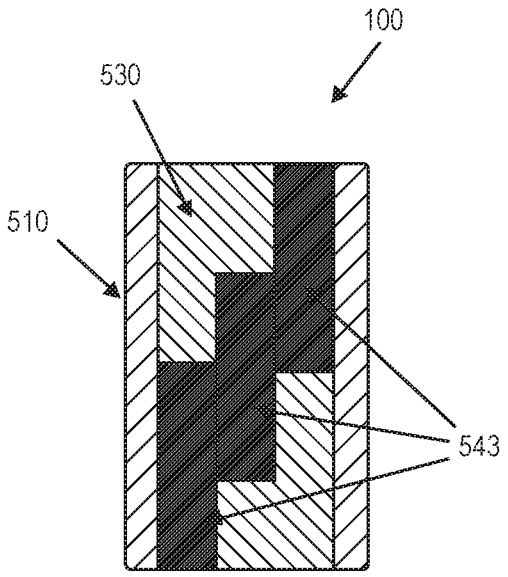
FIG. 5 depicts a front view of one or more discontinuous inlays within a channel in accordance with the present teachings.

Inlays can optionally have a shape that does not match a shape of the base. In other words, inlays can optionally not form a continuous loop to match a shape of the article of jewelry such as ring or bracelet. FIG. 5 shows a front view of an article of jewelry 100, for example a ring, including a base 510 and a channel 530. Disposed in channel 530 are a plurality of inlays 543, each of the plurality of inlays 543 have a shape that does not match the shape of article of jewelry 100. As shown in FIG. 5, article of jewelry 100 is a ring having an annular shape to fit on a wearer's finger. Each inlay of the plurality of inlays 543 has a rectangular shape and are disposed in channel 530 without having an annular shape similar to the ring depicted in FIG. 5. These inlays are also referred to herein as discontinuous inlays because they do not form a continuous loop shape. Because plurality of inlays 543 are formed of a compressible material such as a polymer, as disclosed herein, plurality of inlays 543 that are discontinuous can be elastically held within channel 130 by compression despite not having an annular shape that matches the ring or other articles or jewelry. Moreover, each inlay of the plurality of inlays 543 can have a same or a different shape.

Inlays can optionally be colored to mimic other materials, for example turquoise, meteorite, etc. Inlays can further include materials suspended or dissolved into the material forming the inlay to change an appearance of the inlay, for example, gold or diamond dust, etc. And, inlays can optionally include fluorescent and/or color changing materials. Inlays can further be formed of a porous material that holds a liquid, an oil, a wax, a gel, or combinations thereof, for example, to emit a scent.

Figure 6A:
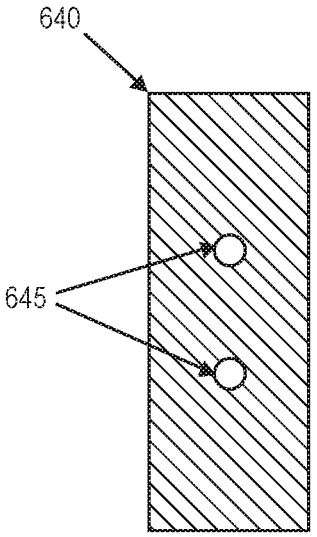
FIGS. 6A-B depict a front view of an inlay with one or more holes to hold gemstones in accordance with the present teachings.
Figure 6B:
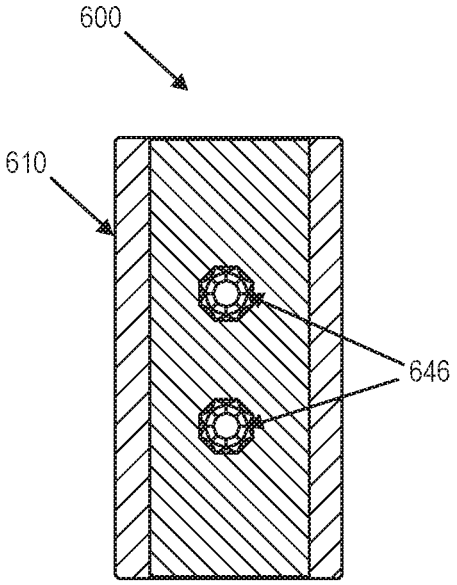

Inlays can optionally include holes sized, for example, to hold gemstones in tension. FIG. 6A shows an inlay 640 including one or more holes 645 that extend through a thickness of inlay 640. FIG. 6B shows an article of jewelry 600, for example a ring, with a base 610 and an inlay 640 disposed in a channel of base 610. A gemstone 646 can be disposed within each of the one or more holes 645. One or more holes 645 are sized to hold gemstones 646 in tension. Optionally gemstones 646 can be mounted on a stud that can be held in tension by one or more holes 645.

Figure 7A:
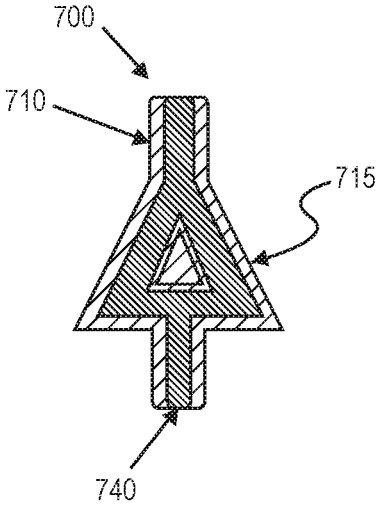
FIGS. 7A-B depict front views of an article of jewelry including both a base and a channel having a pattern and/or design in accordance with the present teachings.
Figure 7B:
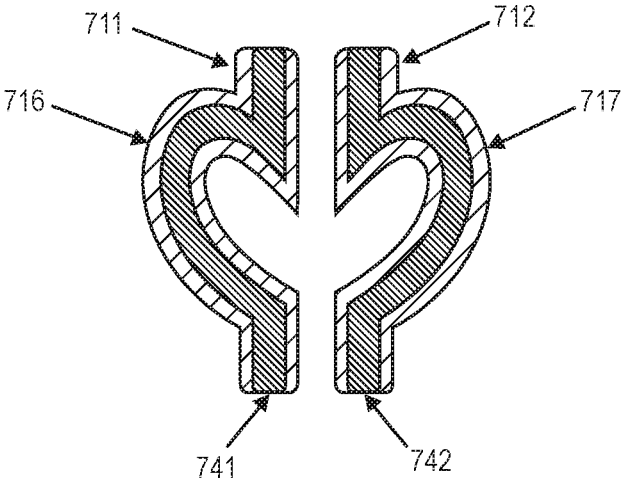

The article of jewelry can further include a base that has an annular shape, for example a ring that fits on a finger, but further includes a decorative design and/or pattern. FIG. 7A schematically depicts an article of jewelry 700, for example, a ring having an annular shape to fit on a finger and having a base 710 that includes a decorative design 715. Base 710 including design 715 can further include a channel having an annular shape that extends around an outward facing surface portion of base 710 and also includes the decorative design in which an inlay 740 fits into. Inlay 740 matches the shape and design of the channel in base 710 and fits within the channel. FIG. 7B schematically depicts an article of jewelry 701, for example, a ring having an annular shape to fit on a finger and being formed of more than one base, for example a first base portion 711 and a second base portion 712. First base portion 711 includes a decorative design 716 and second base portion 712 includes a decorative design 717. Each of first base portion 711 and second base portion 712 further include a channel having an annular shape that extends around an outward facing surface portion of base first base portion 711 and second base portion 712 and further includes decorative design to match. An inlay 741 can be disposed in the channel of first base portion 711 and an inlay 742 can be disposed in the channel of second base portion 712, so that together decorative designs 716 and 717 form another decorative design, for example, a heart design. Inlays 741 and 742 match the shape of the channels in base 711 and 712 and fit with the channels.

Figure 8A:
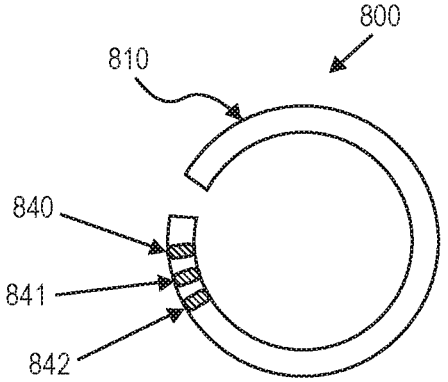
FIGS. 8A-B depict a side view and a front view of an open type article of jewelry such as a bracelet including a base having one or more channels arranged around a thickness of a band of the bracelet in accordance with the present teachings.
Figure 8B:
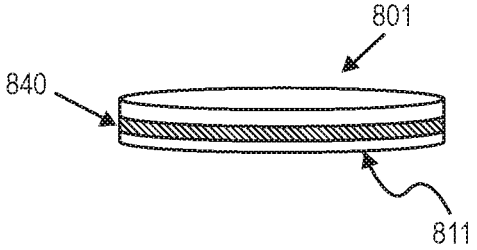

As previously discussed, the article of jewelry is not limited to a ring and the one or more channels are not limited to extend around just an outward facing circumference of the surface portion of the article of jewelry. FIG. 8A is a side view depicting an open type bracelet 800 including a base 810 having three channels arranged around a thickness of a band of the bracelet. Inlays 840, 841, and 842 are disposed in the three channels. A bracelet can also be a closed loop type bracelet. FIG. 8B shows a front view of a closed loop bracelet 801 including a base 811 with one or more channels disposed around the outer circumference of a surface portion of the base 811. One or more inlays 840 can be disposed within the one or more channels.

Figure 9A:
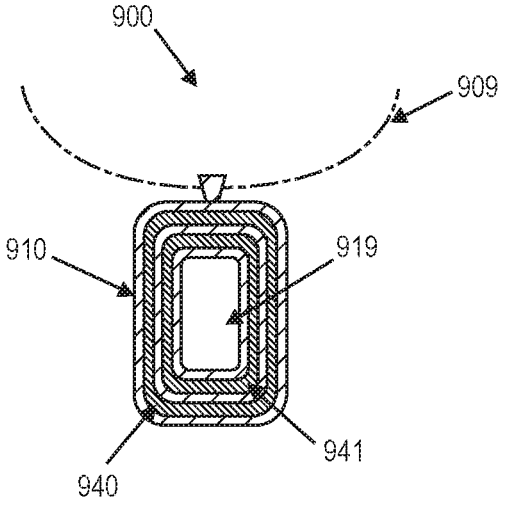
FIGS. 9A-B depict a front view of pendants including one or more inlays in one or more channels in accordance with the present teachings.
Figure 9B:
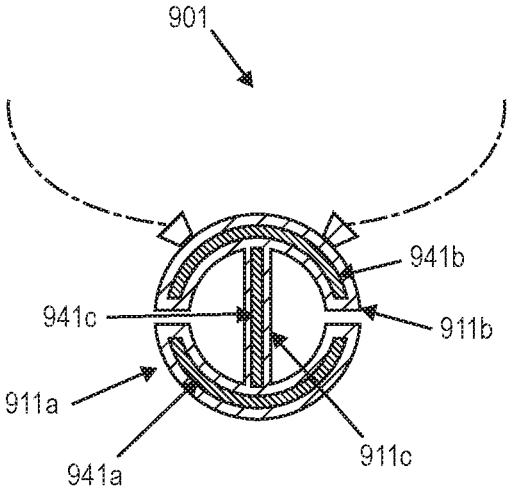

The article of jewelry can further be other types of jewelry including, but not limited to, earrings or pendants having inlays of various shapes, sizes, colors, textures, and dimensions. FIGS. 9A-C depict front view of pendants including one or more inlays. FIG. 9A depicts a front view of a pendant 900 including a base 910 with on or more channels. Pendant 900 may or may not include a necklace 909 from which pendant 900 can be attached. One or more inlays 940, 941 can be disposed in the one or more channels of base 910. Base 910 can optionally include an open portion 919, for example, that can be used to mount an inlay having a same shape as open portion 919, that can be used to mount gemstones or other decorative features, or that can be a hole that extends through a thickness of base 910. Although depicted as having a rectangular shape with rounded corners, base 910 including the one or more channels and one or more inlays 940, 941 can have a shape as desired such as, for example, geometric shapes, non-geometric shapes, and other shapes common to jewelry.

FIG. 9A depicts a front view of a pendant having one or more discontinuous inlays. Pendant 901 includes a base formed of multiple base portions, for example, a first base portion 911*a*, as second base portion 911*b*, can a third base portion 911*c*. Each base portion can optionally include a channel and an inlay disposed in each channel. As shown in FIG. 9B, first base portion 911*a* includes a channel with a first inlay 941*a* disposed in the channel, second base portion 911*b* includes a channel with a second inlay 941*b* disposed in the channel, and third base portion 911*c* includes a channel with a third inlay 941*c* disposed in the channel. As depicted in FIGS. 9A-B, the channels in the base and/or the inlays do not need to be annular in shape or continuous in shape.

Figure 10A:
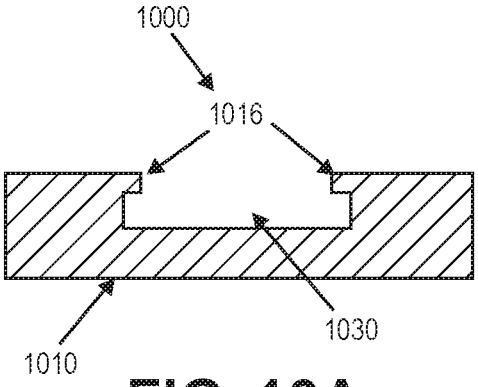
FIGS. 10A-B show a cross sectional view of an article of jewelry including a channel with a wing positioned in one or both sides of channel and an inlay disposed in the channel in accordance with the present teachings.

The channels and base can also include one or more wings (also referred to herein as one or more lips) to further secure the inlays in channels. FIG. 10A shows a cross sectional view of an article of jewelry 1000, for example a ring, having a base 1010 with a channel 1030. Base 1010 can further include a wing 1016 positioned at one or both sides of channel 1030. Wing 1016, disposed on one or both sides of channel 1030, can extend along an entire length of channel 1030 or along only a portion of channel 1030.

Figure 10B:
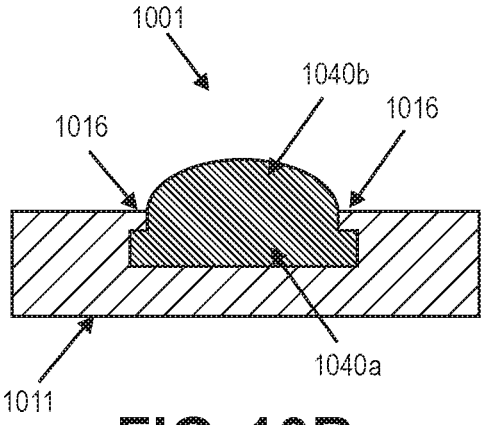

Inlays can further have a shape that extends past a top of the channel so the inlay does not sit flush with the top surface of the article of jewelry. FIG. 10B shows a cross sectional view of an article of jewelry 1001, for example a ring, having a base 1011 with a channel. Base 1011 can optionally include a wing 1016 positioned at one or both sides of the channel that can extend along an entire length of channel or along only a portion of channel. An inlay can include a first portion 1040*a* having a shape that matches a shape of the channel, either with or without wings. The inlay can optionally include a second portion 1040*b* that extends beyond a top of the channel so it does not appear flush with a surface of article of jewelry 1001.

Figure 11:
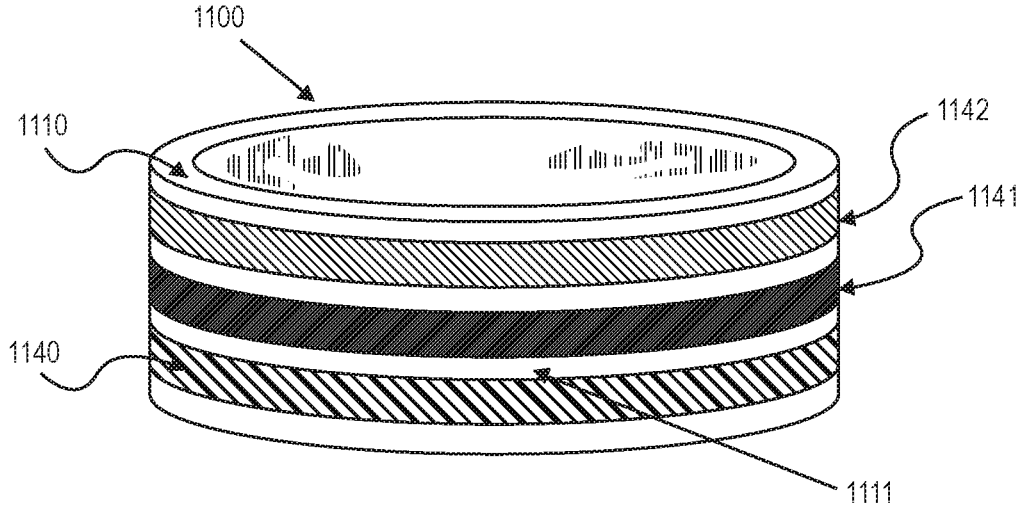
FIG. 11 depicts a ring including a plurality of channels and inlays having varying colors in accordance with the present teachings.

FIG. 11 shows an article of jewelry 1100 including a plurality of channels with one inlay in each channel. Article of jewelry 1100 has a base 1110 wherein base 1110 has an annular shape. Base 1110 can be formed of any solid material as disclosed herein, for example, titanium as depicted in FIG. 11. An outer surface 1111 of base 1110 includes, for example, three channels disposed circumferentially in outer surface 1111. Within each of the plurality of channels is disposed one inlay formed of an elastomer. The elastomer can be any of those disclosed herein, for example, silicone. FIG. 11 shows a plurality of inlays 1140, 1141, and 1142, each having an annular shape and a diameter to allow it to be elastically held in tension within the channel. Inlays 1140, 1141, and 1142 further have an elasticity to allow repeated removal from and addition to the plurality of channels without fracturing.

As further depicted in FIG. 11, when inlays 1140, 1141, and 1142 are elastically held in tension within their respective channels, outer surface 1111 visually appears smooth and continuous with respect to the inlays. Optionally, inlays 1140, 1141, and 1142 can have a color, a pattern, a texture, a phosphorescence, or combinations thereof as disclosed herein. Inlays 1140, 1141, and 1142 can have a same or different color as desired, and inlays 1140, 1141, and 1142 can have a same or different width and/or or a same or different thicknesses. For example, as shown in FIG. 11, inlay 1140 has a first color, inlay 1141 has a second color, and inlay 1142 has a third color.

Figure 12:
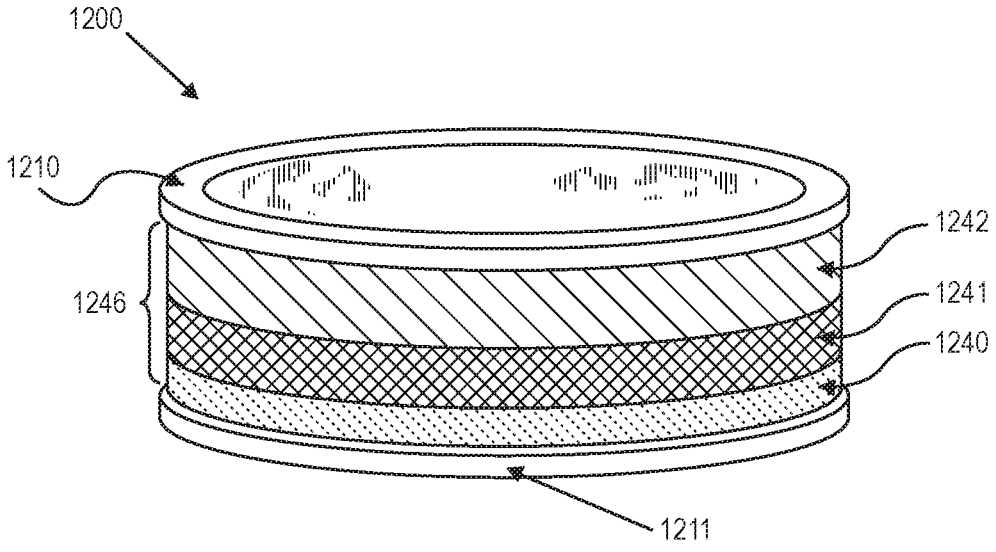
FIG. 12 depicts a ring including a channel in an outer surface of the ring and a plurality of inlays within the channel in accordance with the present teachings.

FIG. 12 shows an article of jewelry 1200 including one channel with a plurality of inlays in the channel. Article of jewelry 1200, for example a ring, has a base 1210 wherein base 1210 has an annular shape. Base 1210 can be formed of any solid material as disclosed herein, for example, gold as depicted in FIG. 12. An outward surface 1211 of base 1210 includes, for example, a channel disposed circumferentially in outward surface 1211. Within the channels is disposed a plurality of inlays formed of an elastomer. The elastomer can be any of those disclosed herein, for example, silicone as depicted in FIG. 12. FIG. 12 shows a plurality of inlays 1240, 1241, and 1242, each having an annular shape and a diameter to allow it to be elastically held in tension within the channel. Inlays 1240, 1241, and 1242, further have an elasticity to allow repeated removal from and addition to the channel without fracturing. Inlays 1240, 1241, and 1242 can have a same or different widths and/or or a same or different thicknesses. The number of inlays can vary as long as the total width of the inlays allows placement within the channel. For example, inlays 1240, 1241, and 1242 shown in FIG. 12 each have a different widths, but all fit within the channel.

As depicted in FIG. 12, when inlays 1240, 1241, and 1242 are elastically held in tension within the channel, an outer surface 1246 of inlays 1240, 1241, and 1242 visually appears smooth and continuous. As disclosed herein, inlays 1240, 1241, and 1242 can have a color, a pattern, a texture, a phosphorescence, or combinations thereof. For example, as shown in FIG. 12, inlay 1240 has a white color, inlay 1241 has a yellow color, and inlay 1243 has an orange color. As further disclosed herein, the elastomer forming inlays 1240, 1241, and 1242 can be a porous material and include a liquid, an oil, a wax, a gel, or combinations thereof emit a scent, for example, perfume or aromatherapy oils.

While the present teachings have been illustrated with respect to one or more implementations, alterations and/or modifications can be made to the illustrated examples without departing from the spirit and scope of the appended claims. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B, means A alone, B alone, or A and B. The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "about" indicates that the value listed may be somewhat altered, as long as the alteration does not result in nonconformance of the process or structure to the illustrated implementation. Finally, "exemplary" indicates the description is used as an example, rather than implying that it is an ideal. Other implementations of the present teachings will be apparent to those skilled in the art from consideration of the specification and practice of the disclosure herein. It is intended that the specification and examples be considered as exemplary only, with a true scope and spirit of the present teachings being indicated by the following claims.

What is claimed is:

1. An article of jewelry comprising;

a base comprising an annular shape, wherein the base further comprises two or more channels disposed circumferentially in an outward facing portion of the annular shape and a first sidewall on a first side of the two or more channels and a second sidewall on a second side of the two or more channels; and one or more inlays comprising an elastomer, wherein each of the one or more inlays comprise an annular shape and a diameter to be elastically held in tension within one of the two or more channels, wherein the elastomer comprises an elasticity to allow repeated removal of the one or more inlays from the two or more channels without fracturing, wherein the first sidewall comprises a plurality of holes disposed to expose a portion of a side of one of the one or more inlays, and wherein each of the two or more channels comprises a width that is different than a width of others of the two or more channels.

2. The article of jewelry of claim 1, wherein the base comprises metal, wood, ceramic, porcelain, zirconium, meteorite, stone, or combinations thereof.

3. The article of jewelry of claim 1, wherein the two or more channels comprise a bottom and a plurality of sides, a shape of the bottom and the plurality of sides being flat, curved, V-shaped, or combinations thereof.

4. The article of jewelry of claim 1, wherein the two or more channels have a depth from about 0.5 mm to about 5.0 mm.

5. The article of jewelry of claim 1, wherein the two or more channels comprise a repeating pattern, a design, or both.

6. The article of jewelry of claim 1, wherein the one or more inlays comprise a silicone elastomer, a natural rubber, a styrene-butadiene block copolymer, a polyisoprene, polybutadiene, an ethylene propylene rubber, an ethylene propylene diene rubber, a fluoroelastomer, a polyurethane elastomer, a nitrile rubber, latex, or combinations thereof.

7. The article of jewelry of claim 1, wherein each of the one or more inlays comprise a color, a pattern, a texture, a phosphorescence, a material suspended in the elastomer, or combinations thereof.

8. The article of jewelry of claim 1, wherein the elastomer is a porous material and further comprise a liquid, an oil, a wax, a gel, or combinations thereof to emit a scent.

9. The article of jewelry of claim 1, wherein the one or more inlays and a portion of the base form an outer surface of the article of jewelry that visually appears smooth and continuous when each of the one or more inlays are elastically held in tension within one of the one or more channels.

10. The article of jewelry of claim 1, wherein the one or more inlays comprise an open portion such that a portion of a bottom of at least one of the two or more channels, some or all of a side of at least one of the two or more channels, or both are exposed when each of the one or more inlays are elastically held in tension within one of the two or more channels.

11. The article of jewelry of claim 1, wherein the one or more inlays comprise a braided shape, a shape that extends above a height of at least one of the two or more channels, one or more three dimensional shapes that extend above the height of at least one of the two or more channels, or one or more holes that extend through the inlay and are sized to hold gemstones.

12. The article of jewelry of claim 1, wherein the article of jewelry is a ring, a bracelet, a necklace, or an earring.

13. An article of jewelry comprising;

a base comprising an annular shape, wherein the base further comprises two or more channels disposed circumferentially in a surface portion of the base, wherein each of the two or more channels comprises a width that is different than a width of others of the two or more channels; and one or more inlays comprising an elastomer, wherein each of the one or more inlays comprise an annular shape and a diameter to be elastically held in tension within one of the two or more channels, wherein each of the one or more inlays comprise one or more holes, and, wherein the elastomer comprises an elasticity to allow repeated removal of the one or more inlays from the two or more channels without fracturing, and a gemstone held in tension by each of the one or more holes.

14. The article of jewelry of claim 13, wherein the base comprises metal, wood, ceramic, porcelain, zirconium, meteorite, stone, or combinations thereof and wherein the one or more inlays comprise a silicone elastomer, a natural rubber, a styrene-butadiene block copolymer, a polyisoprene, polybutadiene, an ethylene propylene rubber, an ethylene propylene diene rubber, a fluoroelastomer, a polyurethane elastomer, a nitrile rubber, latex, or combinations thereof.

15. The article of jewelry of claim 13, wherein the one or more inlays have a color, a pattern, a texture, a phosphorescence, or a combination thereof.

16. The article of jewelry of claim 13, wherein each of the gemstones is mounted on a stud that in is held in tension in the holes in each of the one or more inlays.

* * * * *